US007803037B2

(12) United States Patent
Carlson, Jr.

(10) Patent No.: US 7,803,037 B2
(45) Date of Patent: Sep. 28, 2010

(54) CENTERLESS BELT GRINDER

(75) Inventor: Glen A. Carlson, Jr., Bloomfield Hills, MI (US)

(73) Assignee: ACME Manufacturing Company, Auburn Hills, MI (US)

( * ) Notice: Subject to any disclaimer, the term of this patent is extended or adjusted under 35 U.S.C. 154(b) by 439 days.

(21) Appl. No.: 11/983,712

(22) Filed: Nov. 9, 2007

(65) Prior Publication Data

US 2008/0113594 A1 May 15, 2008

Related U.S. Application Data

(60) Provisional application No. 60/858,077, filed on Nov. 9, 2006.

(51) Int. Cl.
*B24B 7/00* (2006.01)
*B24B 21/18* (2006.01)

(52) U.S. Cl. ..... 451/66; 451/67; 451/296; 451/299; 451/449

(58) Field of Classification Search ..... 451/5, 451/49, 53, 57, 65, 66, 67, 296, 299, 307, 451/407, 449, 450, 488
See application file for complete search history.

(56) References Cited

U.S. PATENT DOCUMENTS 3,691,698 A * 9/1972 Schaller ..... 451/5
3,732,648 A * 5/1973 Schaller ..... 451/242
3,908,315 A * 9/1975 Schaller ..... 451/242
4,507,896 A * 4/1985 Smith ..... 451/26
4,570,386 A * 2/1986 Unno et al. ..... 451/5
5,123,213 A * 6/1992 Vinson ..... 451/245
7,147,542 B2 * 12/2006 Memmelaar et al. ..... 451/11
7,303,464 B1 * 12/2007 Orf ..... 451/49
2005/0148288 A1 * 7/2005 Memmelaar et al. ..... 451/11

* cited by examiner

*Primary Examiner*—Timothy V Eley
(74) *Attorney, Agent, or Firm*—Harness, Dickey & Pierce, P.L.C.

(57) ABSTRACT

A multi-head centerless belt grinder for removing material from a workpiece includes a common base and a plurality of grinding heads spaced apart from one another and mounted to the common base. Each grinding head includes a moveable work rest blade, a moveable regulating wheel and a moveable grinding belt positioned by servomotors to centerless grind the workpiece along a common axis of rotation. The grinder is programmable for rapid machine changeover and set-up typically within 2-5 minutes to accommodate a large range of workpiece diameters. This feature results in improved productivity and output as well as greater flexibility for scheduling numerous workpiece diameters within a normal eight-hour work shift. A trough may extend beneath and between each of the grinding heads to more efficiently collect and transfer grinding swarf generated during the grinding process to a filter operable to separate solids within the swarf from coolant.

17 Claims, 22 Drawing Sheets

CENTERLESS BELT GRINDER

CROSS-REFERENCE TO RELATED APPLICATIONS

This application claims the benefit of U.S. Provisional Application No. 60/858,077 filed on Nov. 9, 2006. The disclosure of the above application is herein incorporated by reference.

BACKGROUND

The present disclosure relates to multi-head centerless belt grinding systems for heavy stock removal, intermediate tolerance grinding, and fine surface polishing, normally performed in a single-pass-through operation for rods, bars, tubes, pipe, and other cylindrical workpieces, typically in lengths from 2' (610 mm) long to over 60' (18.3M) long, and in part diameters from 0.500" (12.5 mm) to over 12.000" (300 mm).

More particularly, an improved belt grinding head mounting arrangement with programmable electronic servomotor controls is provided for rapid machine changeover and set-up for multiple workpiece diameters. Furthermore, an improved grinding coolant system efficiently disposes of large amounts of grinding swarf and coolant from the grinding heads and common machine base into a separate recirculating coolant system.

Early multi-head grinding machines were configured with separate standalone grinding heads to perform sequential operations utilizing high powered abrasive belt drives from 20 HP (15 kW) to 100 HP (75 kW). The individual grinding heads sometimes moved relative to one another requiring frequent realignment for machine set-up.

Furthermore, known grinding machines typically are oriented with each grinding belt head horizontally. During the grinding operation, a large amount of coolant mixed with the material removed from the workpiece to create a grinding slurry called swarf. The horizontally oriented belt grinding head tended to collect and accumulate the swarf within the belt head assembly and machine frame. Removal of swarf from the grinding heads was very time consuming and often required major downtime and operator maintenance for cleaning and partial disassembly of the grinder.

SUMMARY

A multi-head centerless belt grinder for removing material from a workpiece includes a common base and a plurality of grinding heads spaced apart from one another and mounted to the common base. Each grinding head includes a moveable work rest blade, a moveable regulating wheel and a moveable grinding belt assembly positioned to simultaneously centerless grind the workpiece along a common axis of rotation.

Additionally, a multi-head centerless belt grinder for removing material from a workpiece includes a plurality of spaced apart grinding heads aligned with one another and adapted to simultaneously remove material from the workpiece. A coolant spray system supplies coolant to each of the grinding heads. A trough extends beneath and between each of the grinding heads to collect and transfer swarf generated during the grinding process to a filter operable to separate solids within the swarf from coolant.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
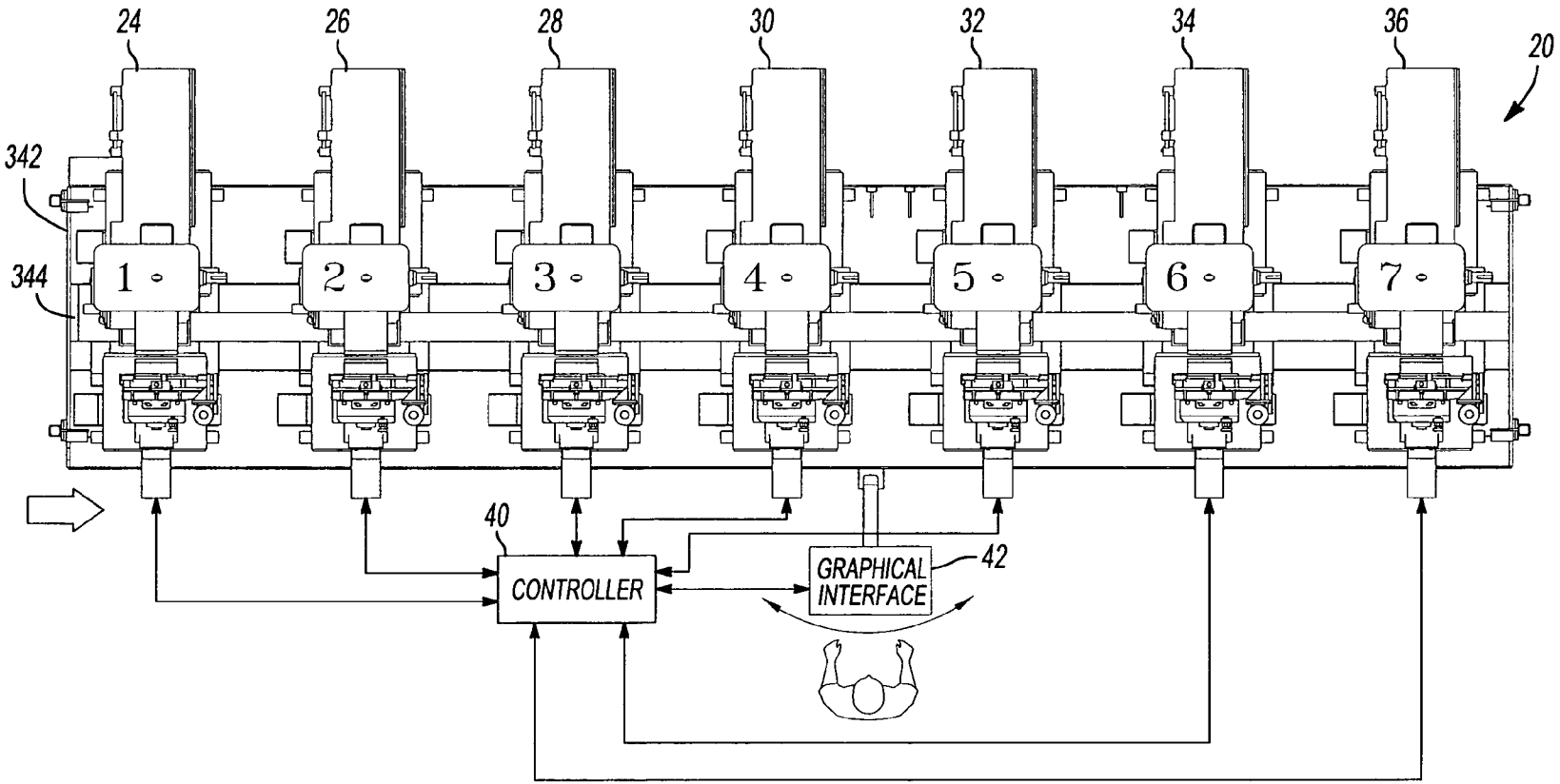
FIG. 1 is a plan view of a grinder constructed in accordance with the teachings of the present disclosure.
Figure 2:
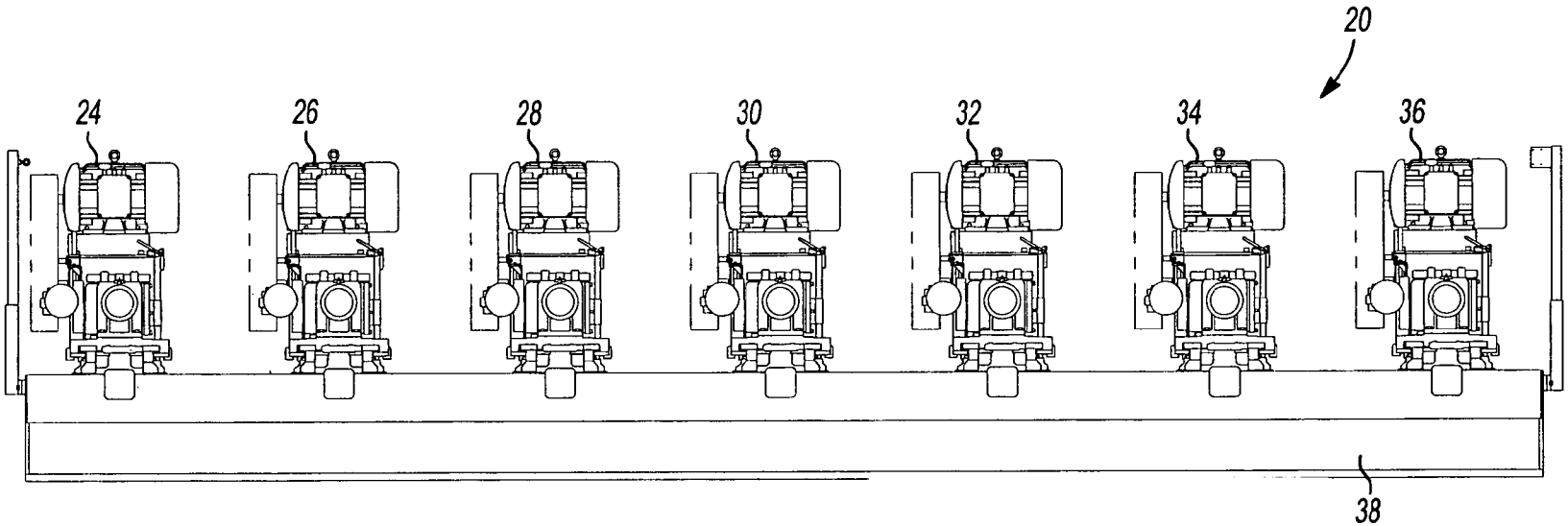
FIG. 2 is a side view of the grinder shown in FIG. 1.

The following description is merely exemplary in nature and is not intended to limit the present disclosure, application, or uses.

FIGS. 1-21 depict a multi-head centerless belt grinder 20. Grinder 20 is useful for removing material from an outer diameter of a cylindrically shaped workpiece 22. Workpiece 22 may be formed as a solid bar or a hollow tube typically ranging between 2 and 60 feet in length. Grinder 20 is operable to machine workpieces having outer diameters ranging from ½" to 12". One exemplary type of workpiece is a drawn-over-mandrel tube used to construct a telescopic cylinder in the hydraulics industry.

Grinder 20 includes seven individually operable grinding heads 24, 26, 28, 30, 32, 34 and 36. Grinding heads 24-36 are spaced apart from one another and each mounted to a common base 38. Separate handling tables (not shown) may be positioned adjacent to base 38 to introduce workpiece 22 to grinder 20 and also accept finished workpieces after the grinding operations have been completed. Depending on the length of the workpiece to be ground, the number of grinding heads 24-36 simultaneously removing material from the workpiece may range from one to seven. The workpiece enters at grinding head 24 where a rough grind operation is performed. Grinding head 24 removes the greatest quantity of material from workpiece 22. Workpiece 22 is axially driven toward grinding head 26 where a finer grit belt is engaged with the workpiece. The simultaneous grinding processes continue until workpiece 22 exits grinding head 36, which may perform a micro-grinding operation.

A controller 40 controls operation of each grinding head 24-36 as will be described in greater detail hereinafter. Controller 40 is also in communication with a graphical interface 42. An operator may interact with graphical interface 42 to control grinder 20. Grinding heads 24-36 are substantially similar to one another. Accordingly, only grinding head 24 will be described in detail.

Figure 5:
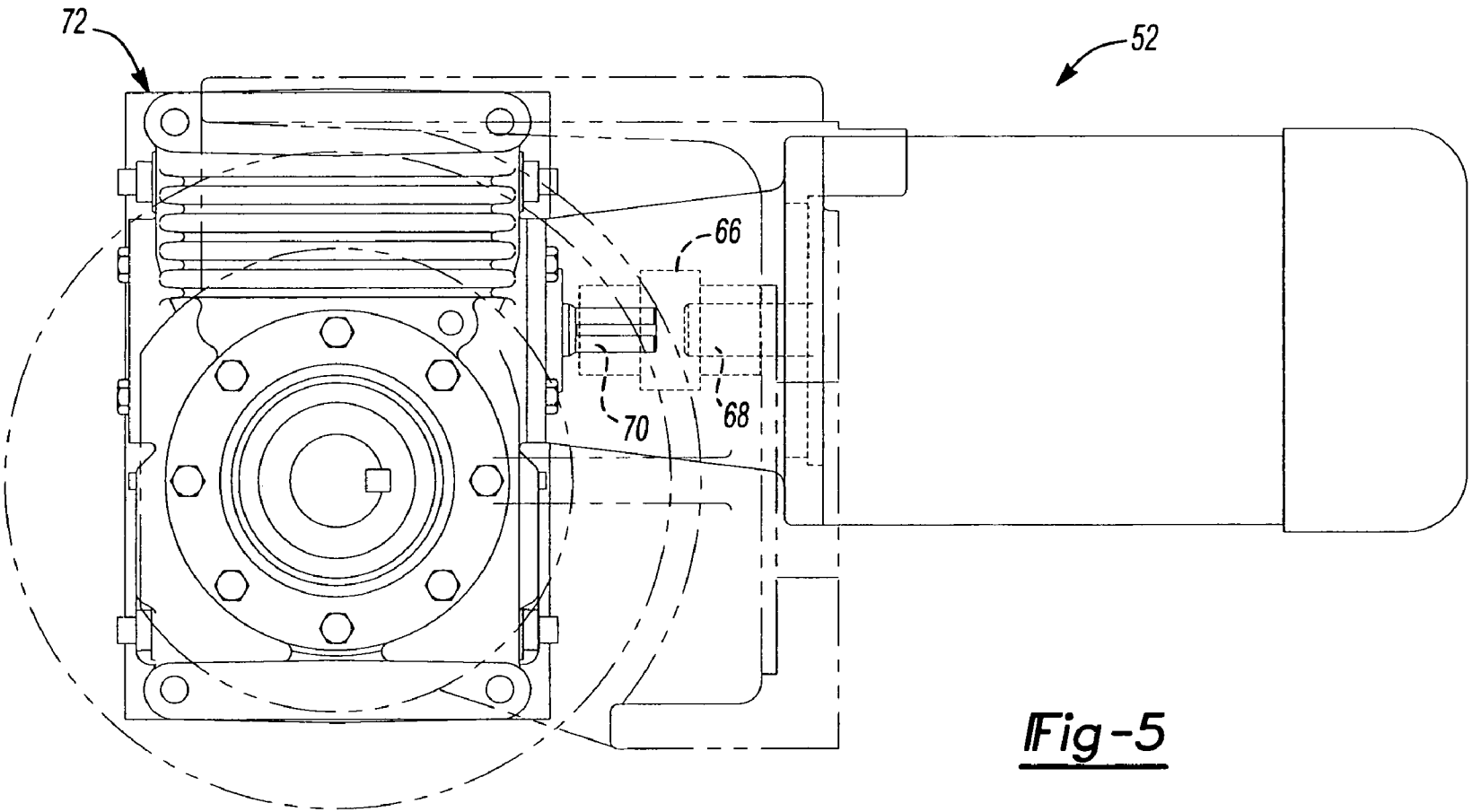
FIG. 5 is a plan view of a regulating wheel assembly.

Grinding head 24 includes a column assembly 50, a regulating wheel assembly 52 and a work rest blade assembly 54. Regulating wheel assembly 52 includes a regulating wheel 56 in contact with an outer surface 57 of workpiece 22 and an electric motor 58. Electric motor 58 is operable to rotate regulating wheel 56 about an axis 60 extending at an angle not parallel to an axis 62 about which workpiece 22 rotates. By arranging regulating wheel assembly 52 in this manner, regulating wheel 56 and electric motor 58 are operable to rotate workpiece 22 about axis 62 while simultaneously axially driving workpiece 22 in the direction indicated by an arrow 64. FIG. 5 depicts further details relating to regulating wheel assembly 52. For example, a coupling 66 drivingly interconnects an output shaft 68 of electric motor 58 with an input shaft 70 of a gear reduction unit 72. The output of gear reduction unit 72 provides torque to regulating wheel 56.

Figure 3:
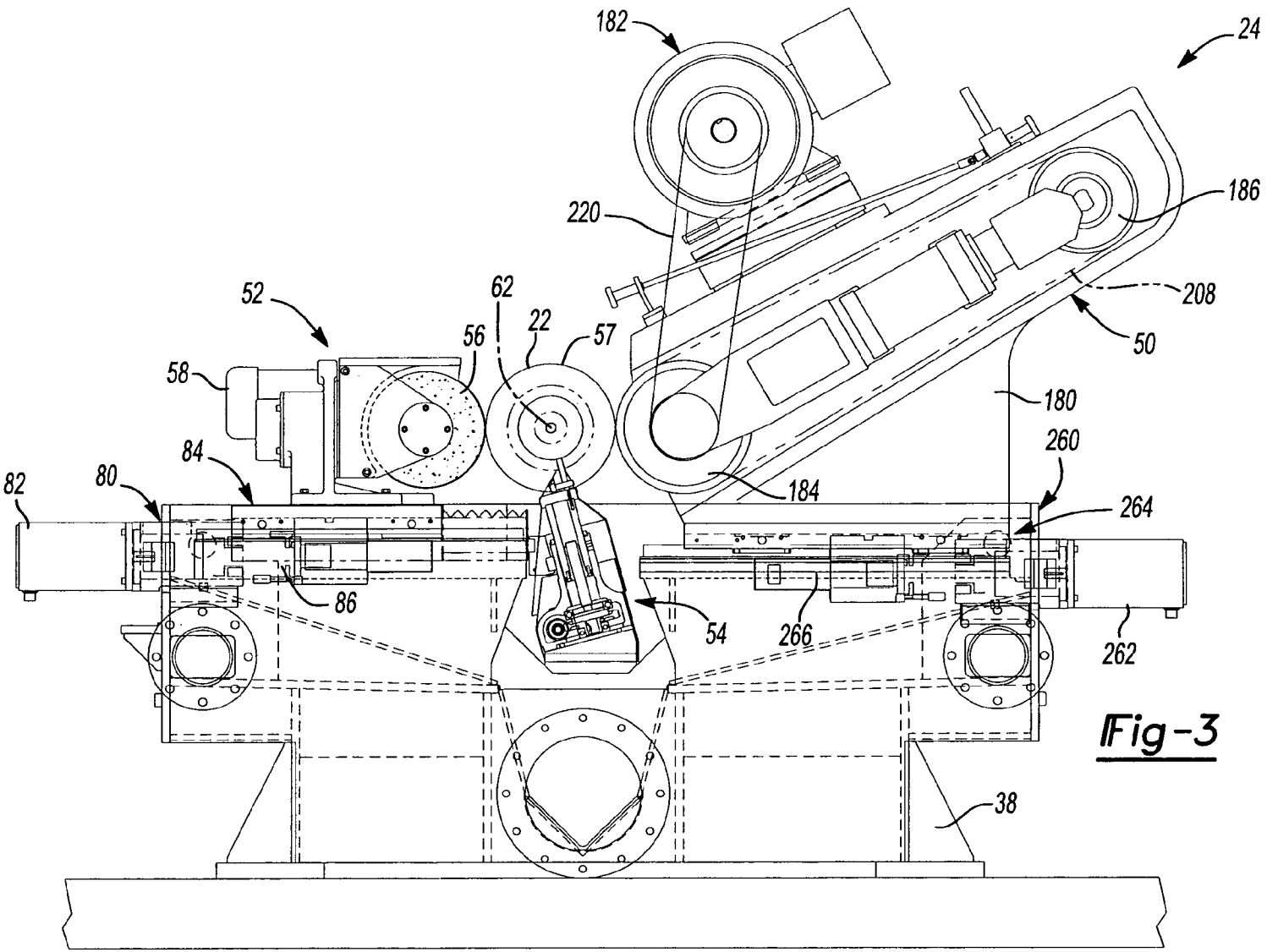
FIG. 3 is a fragmentary end view of the grinder shown in FIG. 2.
Figure 4:
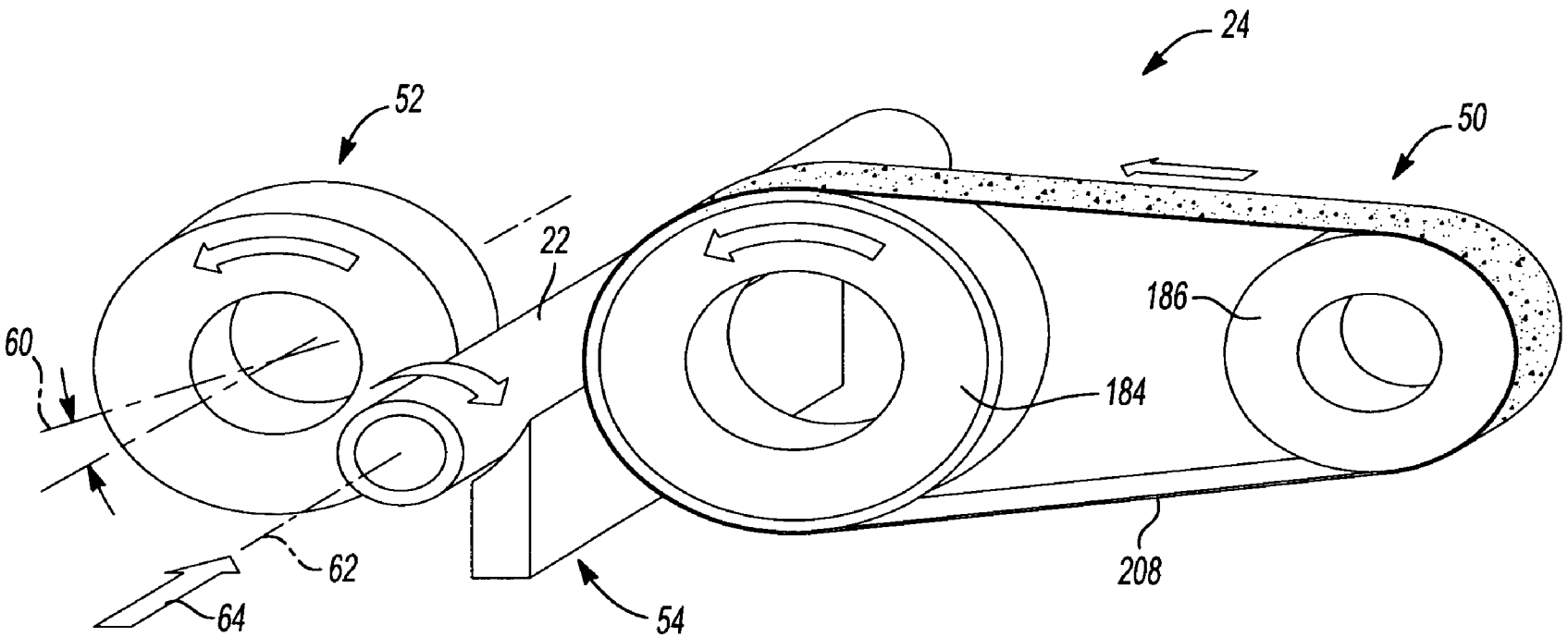
FIG. 4 is a schematic depicting the major components of a grinding head associated with a workpiece.
Figure 6:
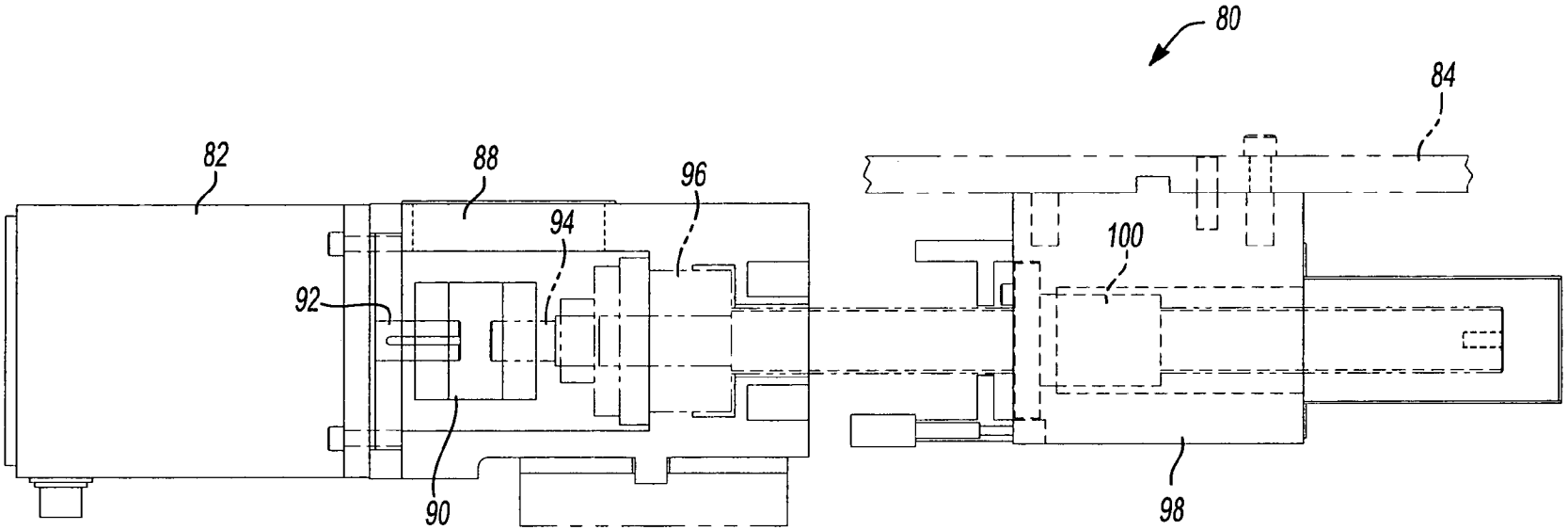
FIG. 6 is a side view depicting a first ball screw assembly.
Figure 7:
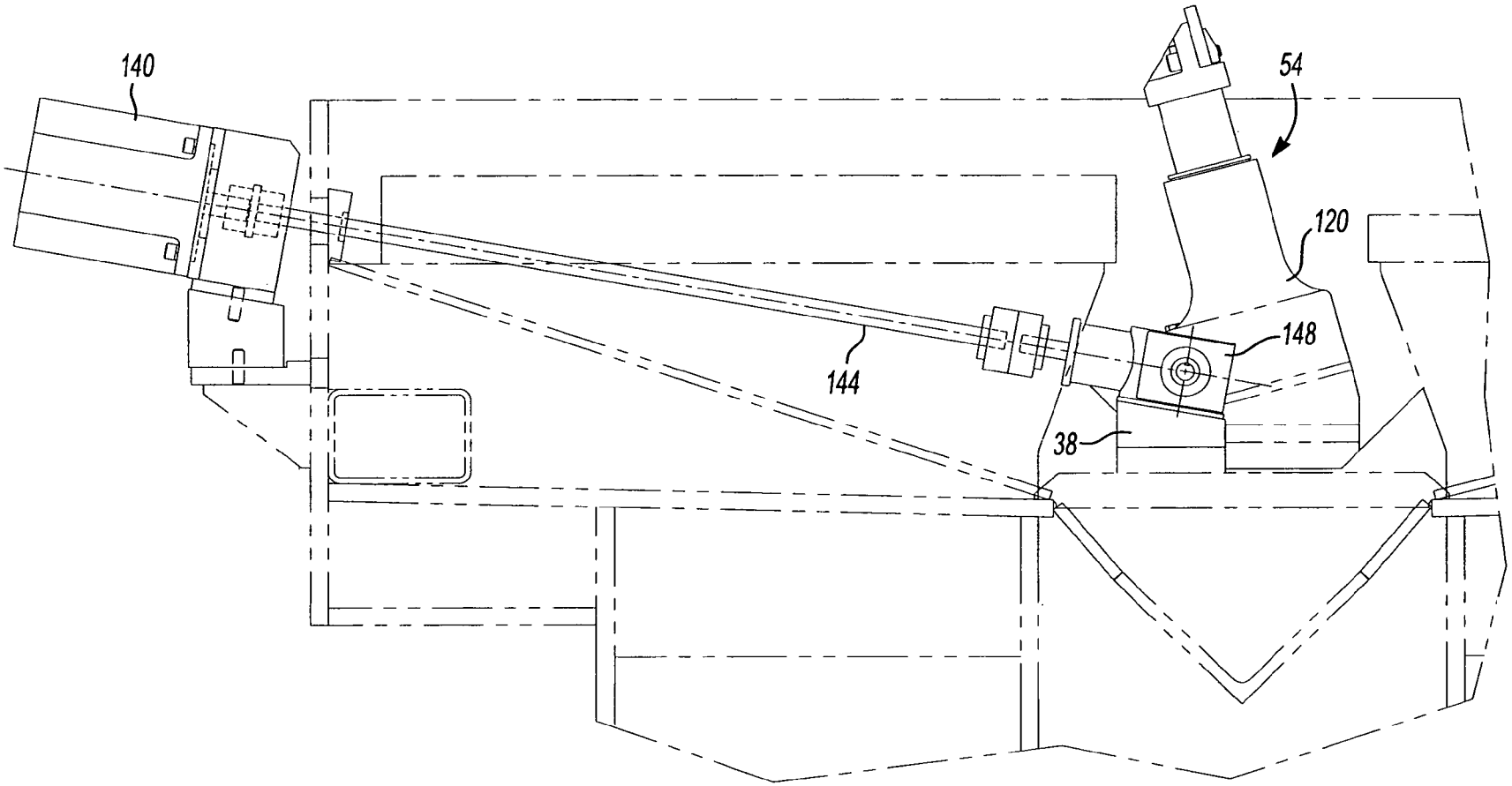
FIGS. 7-10 are views depicting a rest blade assembly.
Figure 8:
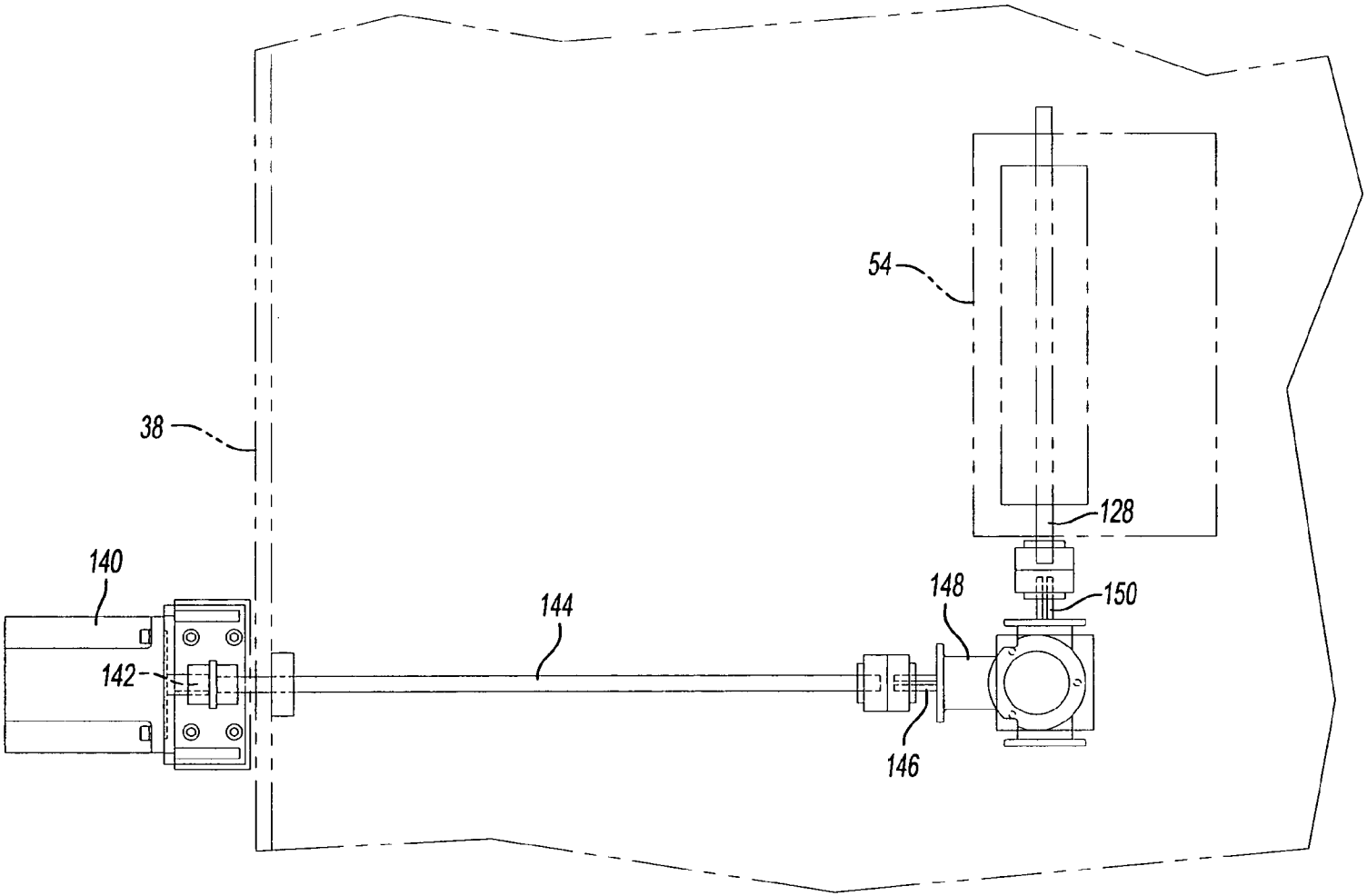
Figure 9:
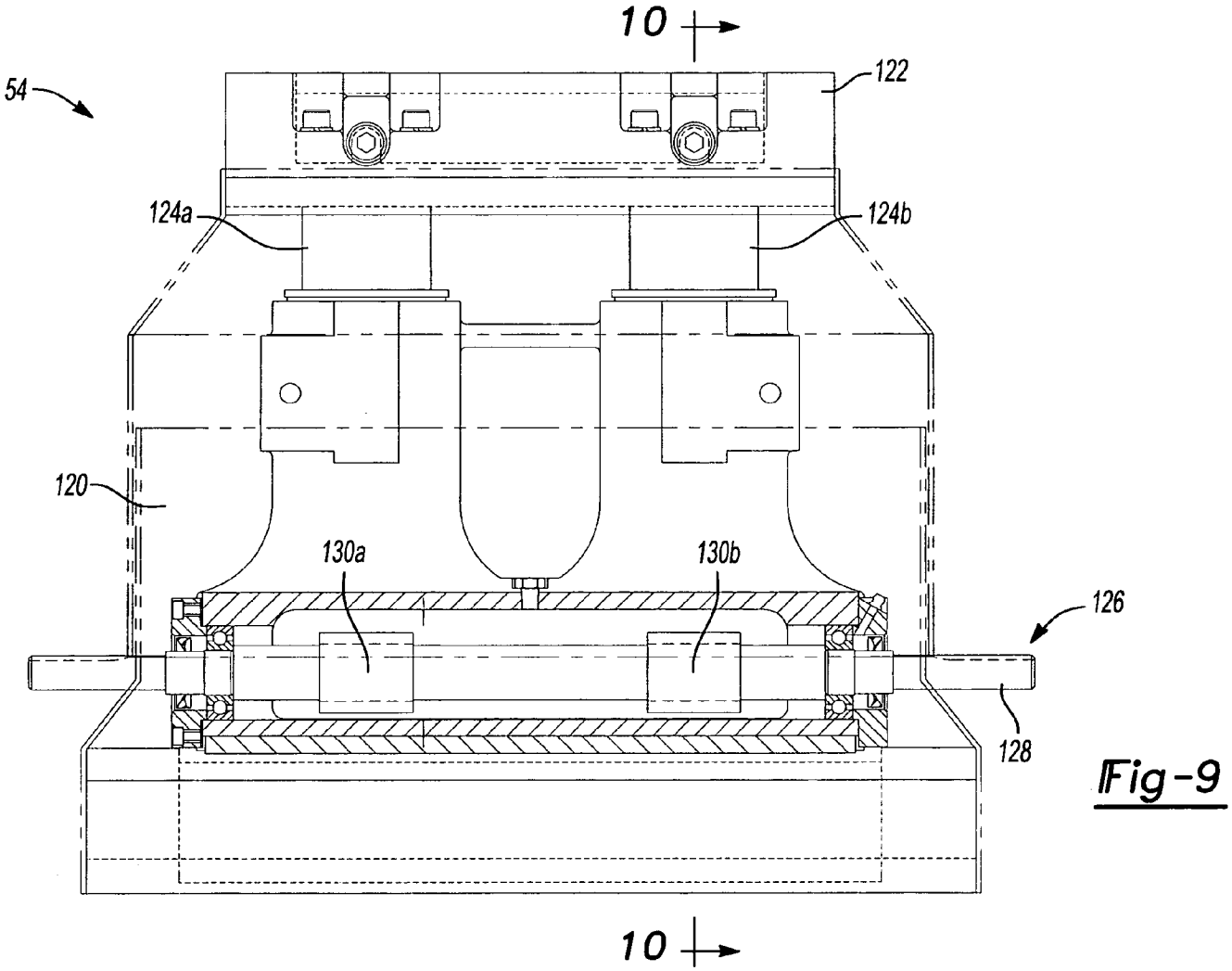

FIG. 3 shows a first ball screw assembly 80 mounted to base 38. Regulating wheel assembly 52 is coupled to first ball screw assembly 80 such that regulating wheel assembly 52 may be axially translated in a direction substantially parallel to the ground. First ball screw assembly 80 includes a first servomotor 82 coupled to a slide assembly 84. A precision ball screw 86 is driven by first servomotor 82 to linearly translate slide assembly 84. FIG. 6 depicts first ball screw assembly 80 in greater detail showing a first servomotor 82 being mounted to a screw housing 88. A coupling 90 is positioned within screw housing 88 to interconnect an output shaft 92 of first servomotor 82 with a ball screw 94. A bearing assembly 96 rotatably supports ball screw 94 within screw housing 88.

A nut housing 98 is spaced apart from screw housing 88 and coupled to a portion of slide assembly 84. A nut 100 is threadingly engaged with ball screw 94 such that rotation of ball screw 94 causes axial translation of nut 100 and nut housing 98. The interconnection and arrangement of first ball screw assembly 80 and regulating wheel assembly 52 allows precise positional control of regulating wheel 56. Varying diameters of workpieces may be accommodated by axial translation of regulating wheel assembly 52 during selective energization of first servomotor 82. Workpieces 22 are aligned along common axis of rotation 62 at each grinding head.

FIGS. 7-10 depict blade assembly 54 including a jack housing 120 fixed to base 38. A rest blade 122 is fixed to sleeves 124*a* and 124*b*. A drive mechanism 126 is operable to move sleeves 124*a* and 124*b* between retracted and extended positions within jack housing 120. Because sleeves 124*a* and 124*b* are substantially similar to one another, drive mechanism 126 relating to only sleeve 124*b* will be described in detail.

Figure 10:
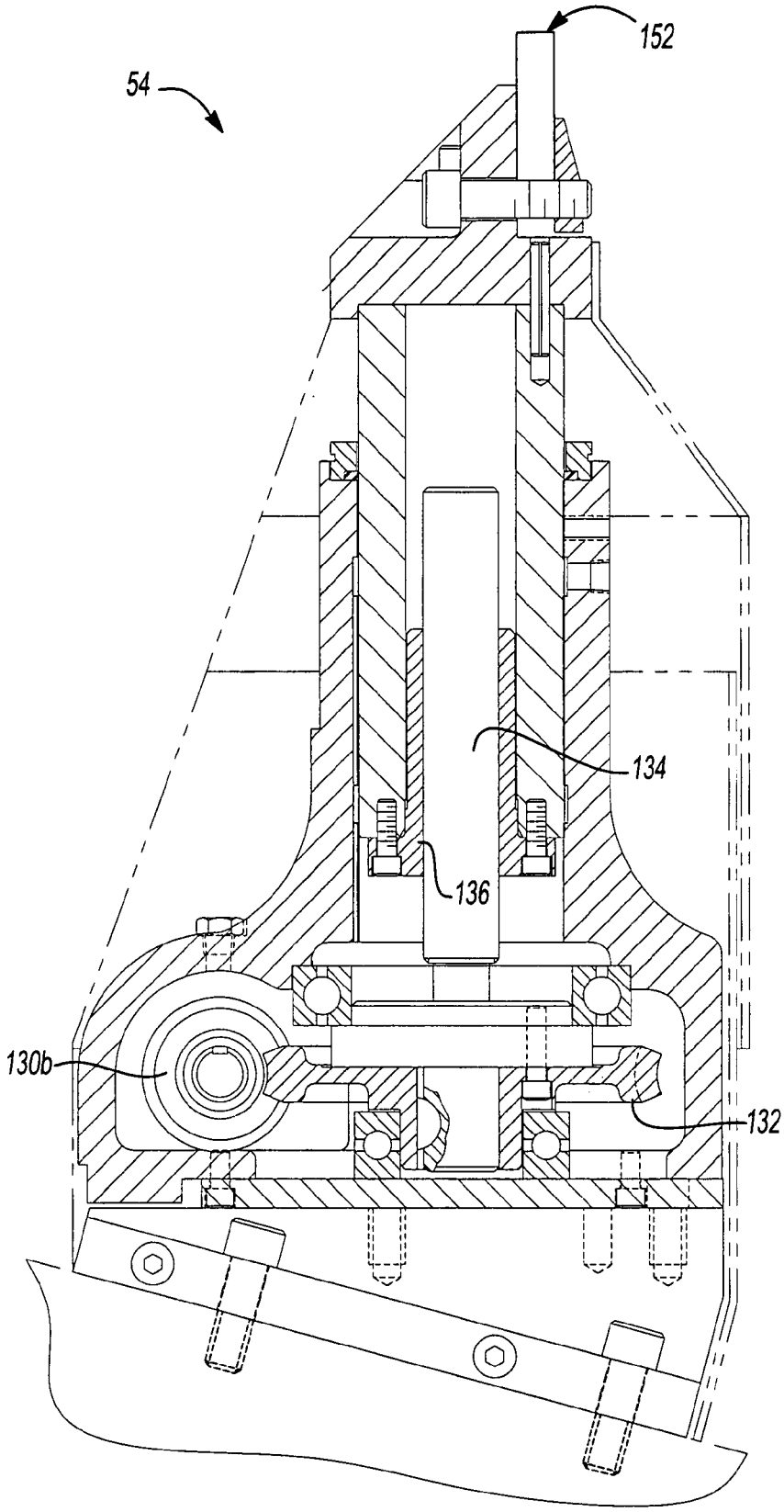
Figure 11:
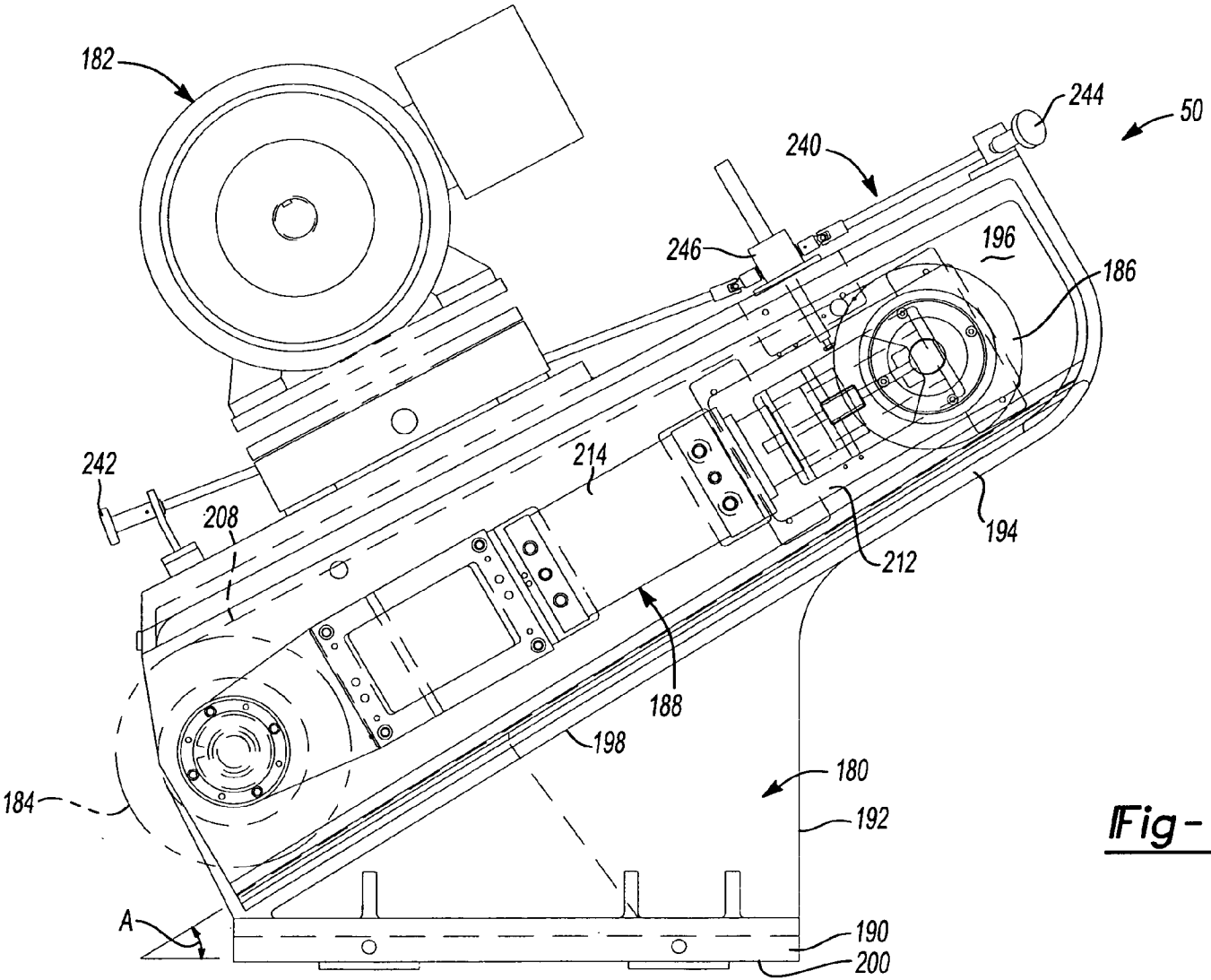
FIGS. 11-14 depict various views of a column assembly including a driven grinding belt.
Figure 12:
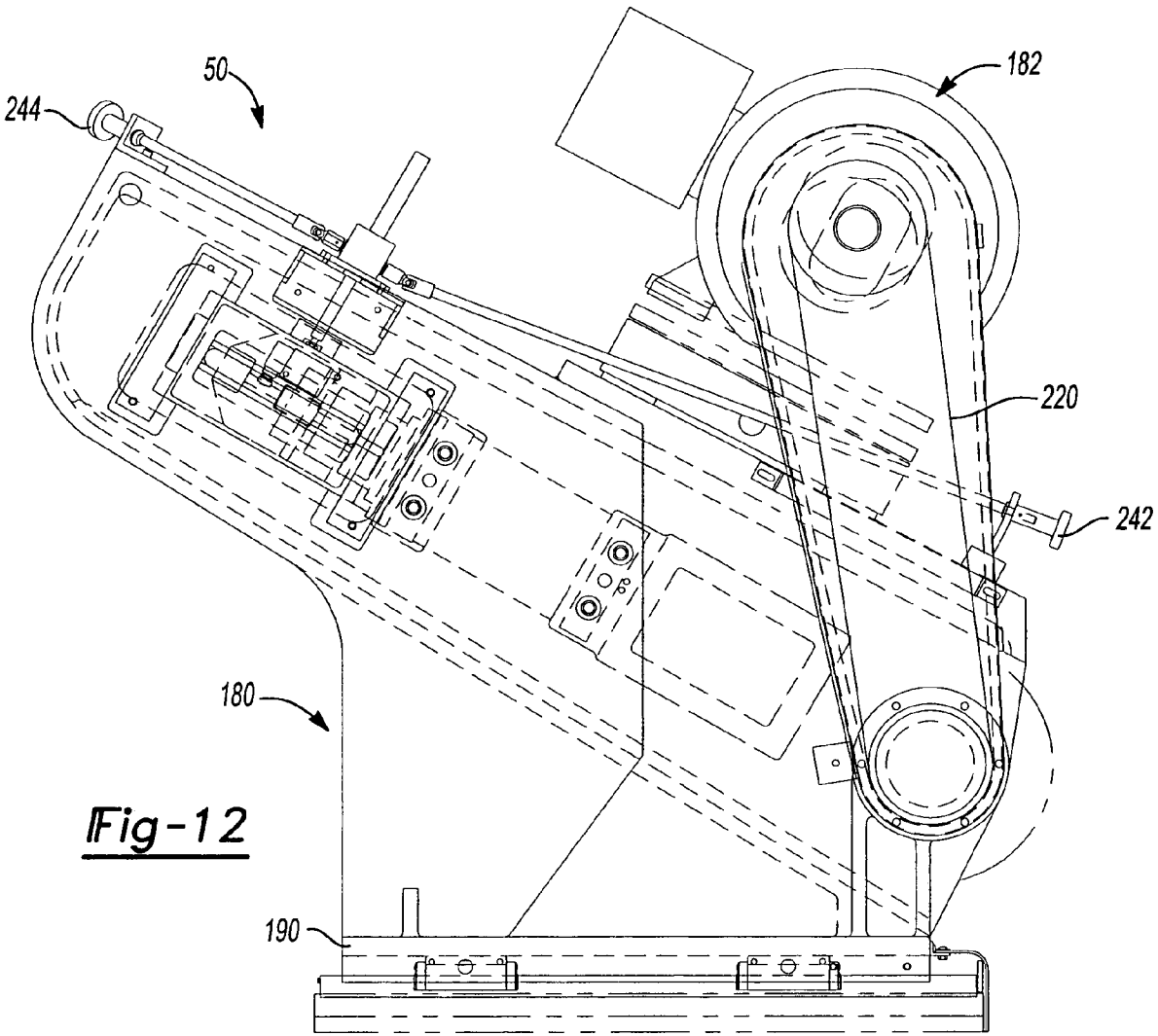
Figure 13:
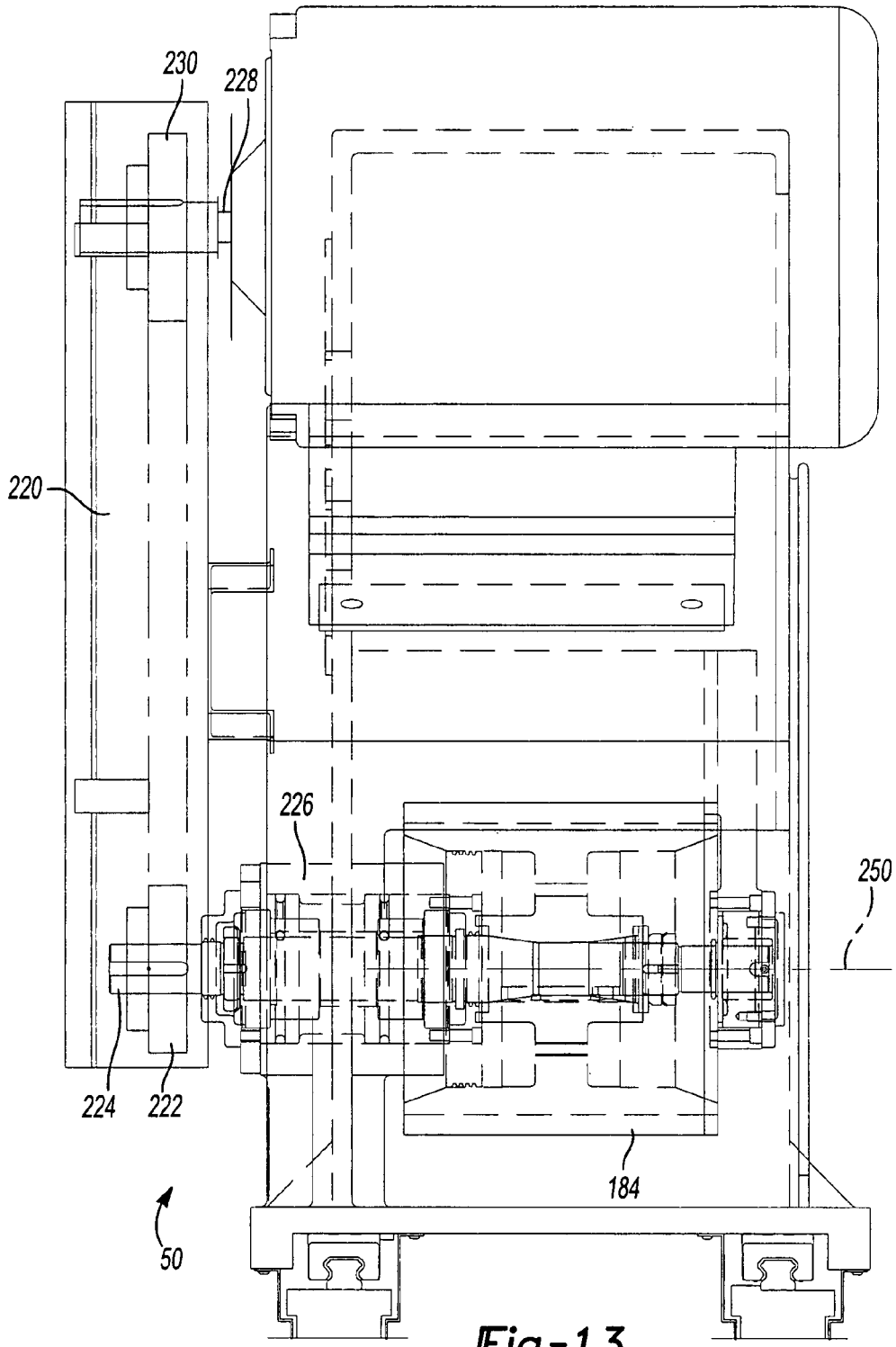
Figure 14:
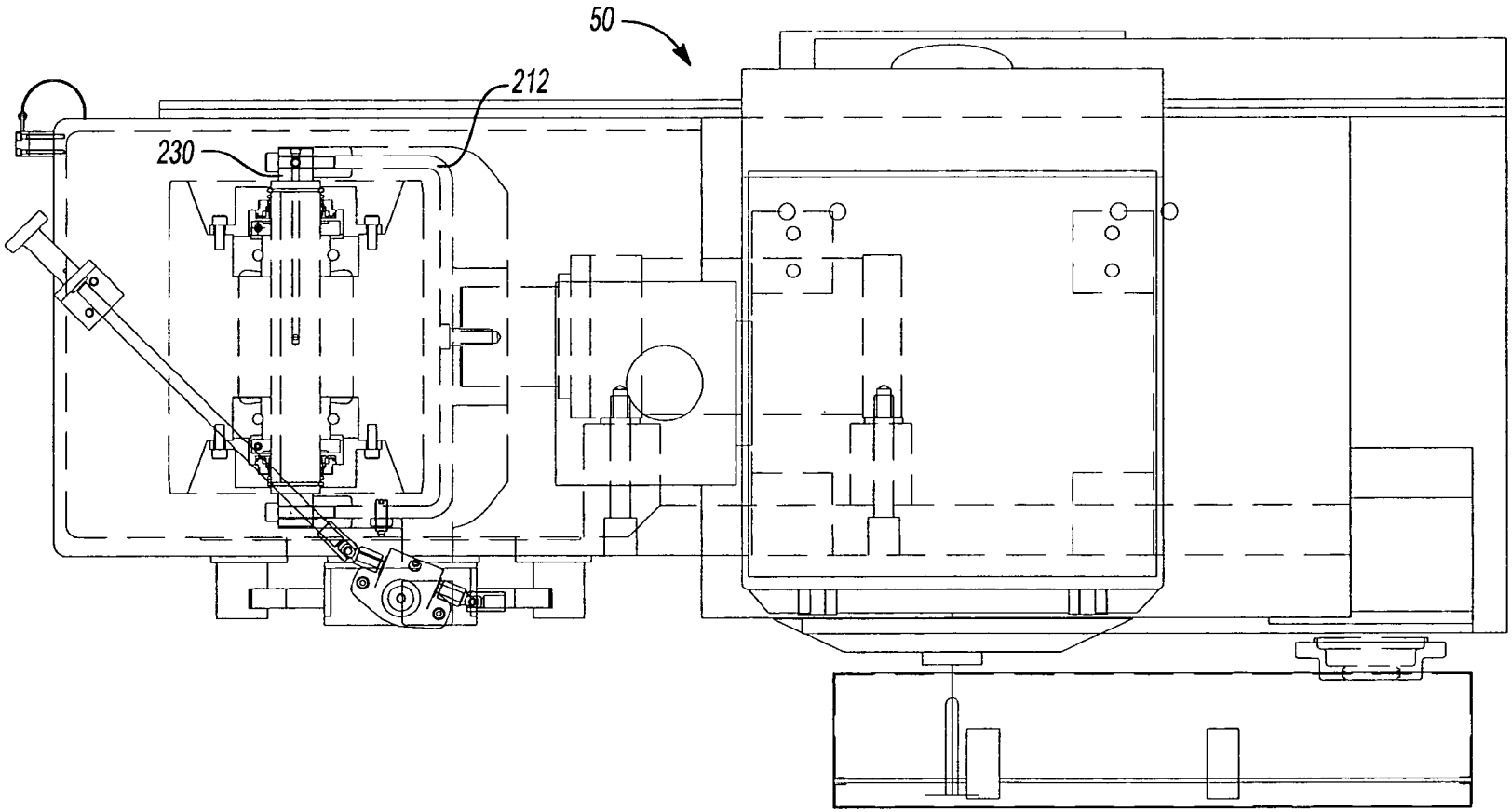

Drive mechanism 126 includes an input shaft 128 rotatably supported by jack housing 120. Worms 130*a* and 130*b* are fixed to or integrally formed with input shaft 128. With reference to FIG. 10, worm 130*b* drivingly engages worm gear 132 to transmit torque to a jack screw 134. Jack screw 134 drivingly engages a jack nut 136. Jack nut 136 is fixed to sleeve 124*b*. Jack screw 134 is free to rotate but restricted from axial movement. Jack nut 136 is restricted from rotation but allowed to axially translate within jack housing 120. Therefore, rotation of input shaft 128 rotates worm 130*b* causing worm gear 132 to rotate in response thereto. Jack screw 134 is fixed for rotation with worm gear 132. Rotation of jack screw 134 causes axial translation of jack nut 136, jack sleeve 124*b* and rest blade 122.

A second servomotor 140 is mounted to base 38 and includes an output shaft 142 drivingly coupled to a longitudinally extending driveshaft 144. Driveshaft 144 is fixed for rotation with an input shaft 146 of a right angle gear box 148. An output 150 of right angle gear box 148 is fixed for rotation with input shaft 128 of blade assembly 54. Second servomotor 140 is in communication with controller 40 such that the position of rest blade 122 may be varied to properly position workpiece 22. Rest blade 122 and sleeves 124*a* and 124*b* are movable between the retracted and extended positions to account for various workpiece outer diameters. A surface 152 of rest blade 122 contacts outer surface 57 of workpiece 22.

Figure 16:
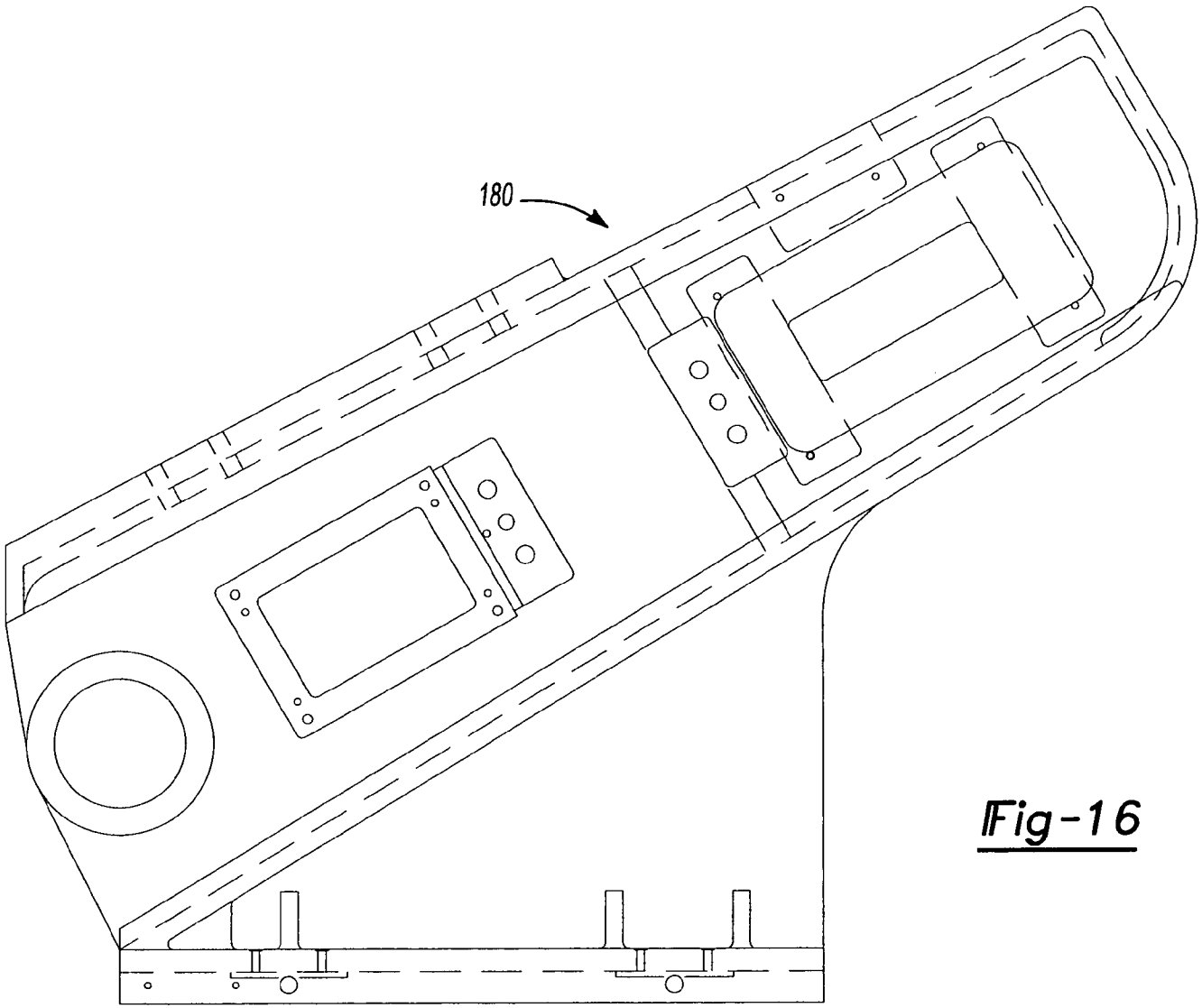
FIGS. 16-18 depict the column in a finished state prior to assembly of the drive motor and grinding belt components.
Figure 17:
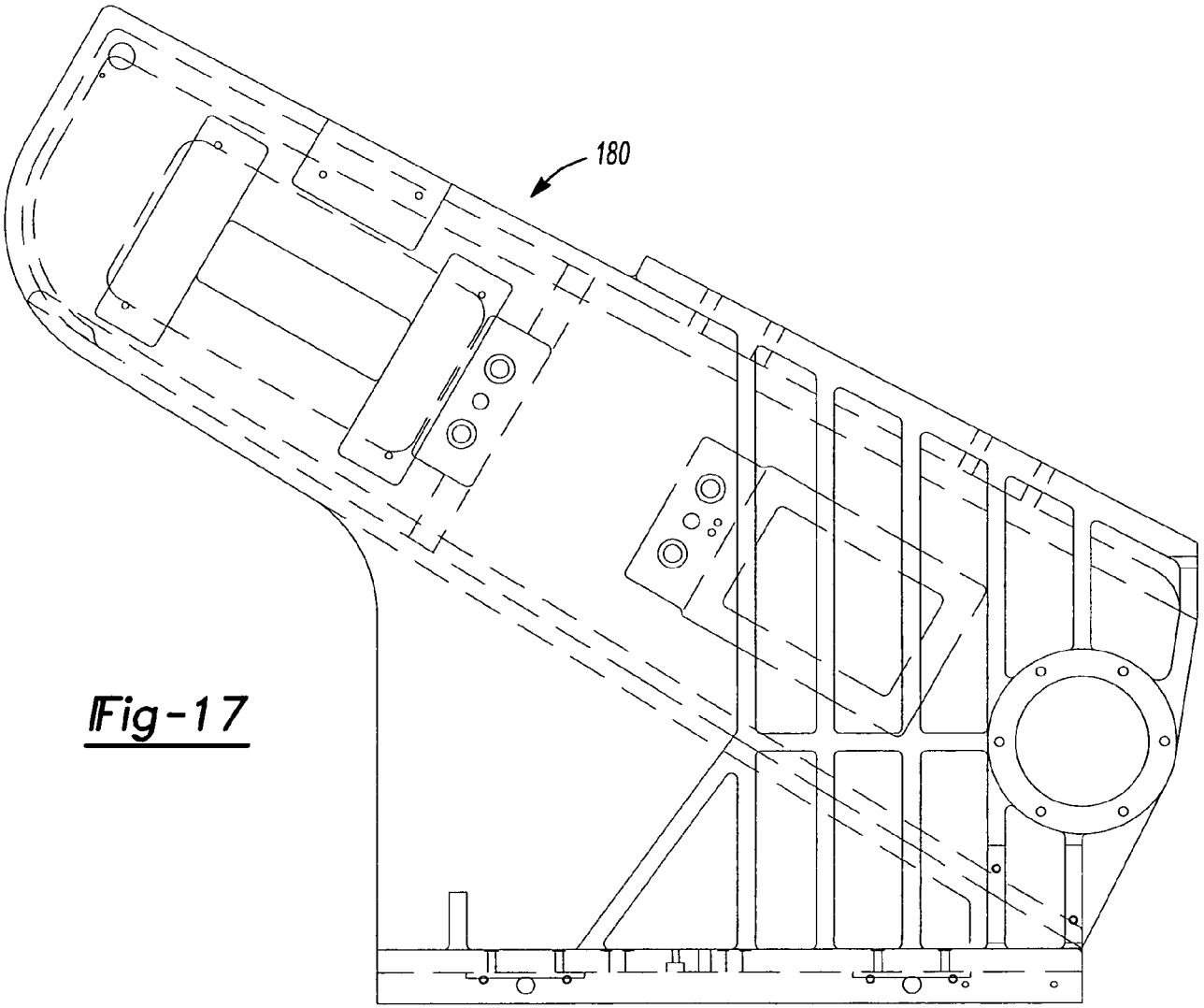
Figure 18:
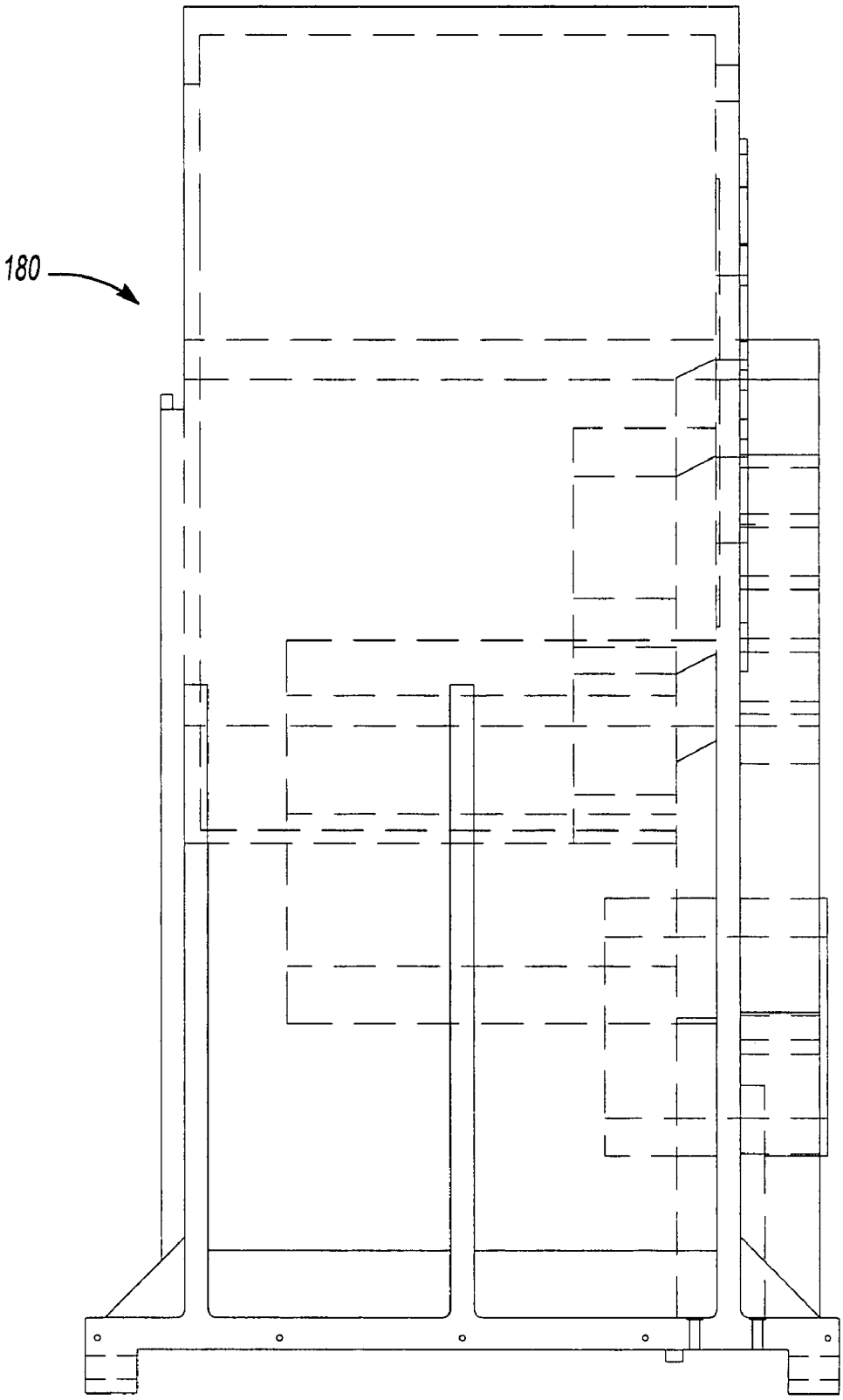

FIGS. 11-15 depict column assembly 50 having a column 180, a drive motor 182, a contact wheel 184, an idler pulley 186 and a belt tensioner 188. Column 180 includes a flange 190, a vertical rib 192 and a shell 194 defining a cavity 196. Shell 194 includes a bottom wall 198 positioned at an angle "A" of approximately 30° to a mounting plane 200 located on flange 190. Mounting plane 200 is positioned substantially parallel to the ground. As such, bottom wall 198 extends at approximately 30° to the ground. It should be appreciated that angle "A" may deviate from 30° as long as a swarf shuttling function is performed. Accordingly, it is contemplated that angle "A" ranges from 20°-70°. FIGS. 16-18 depict column 180 in the finished state prior to assembly of the drive motor and grinding belt components.

With reference once again to FIGS. 11-15, a grinding belt 208 is drivingly engaged with contact wheel 184 and idler pulley 186. In the embodiment disclosed, grinding belt 208 is 12" wide and 120" long. Grinding belt 208 engages outer surface 57 of workpiece 22 to remove material from the workpiece. A bearing assembly 226 rotatably supports contact wheel 184 and an idler pulley yoke 212 rotatably supports idler pulley 186. Belt tensioner 188 interconnects bearing assembly 226 and idler pulley yoke 212. Belt tensioner 188 includes a pneumatic cylinder 214 in receipt of pressurized air to maintain a proper tension on grinding belt 208. As the workpiece is being ground, the material removed by grinding belt 208 mixes with coolant to form a slurry called grinding swarf. Because grinding belt 208 is 12" wide and typically has a grit ranging from No. 36 grit to a fine polishing grit, such as No. 600 grit, a relatively large quantity of swarf is generated during the grinding processes. A grinding coolant spray system 218 (FIG. 20) operable to clear grinding belt 208 of swarf and keep the swarf from interfering with the grinding operation will be described in greater detail hereinafter.

Drive motor 182 is mounted to column 180. A drive belt 220 transfers torque from drive motor 182 to contact wheel 184. More specifically, drive belt 220 engages a pulley 222 mounted on a driveshaft 224. Driveshaft 224 is supported by a bearing assembly 226 mounted within column 180. Driveshaft 224 is rotatably fixed to contact wheel 184 such that rotation of an output shaft 228 of drive motor 182 causes a drive pulley 230 to transmit power through drive belt 220, pulley 222, driveshaft 224 and provide power to contact wheel 184.

Figure 15:
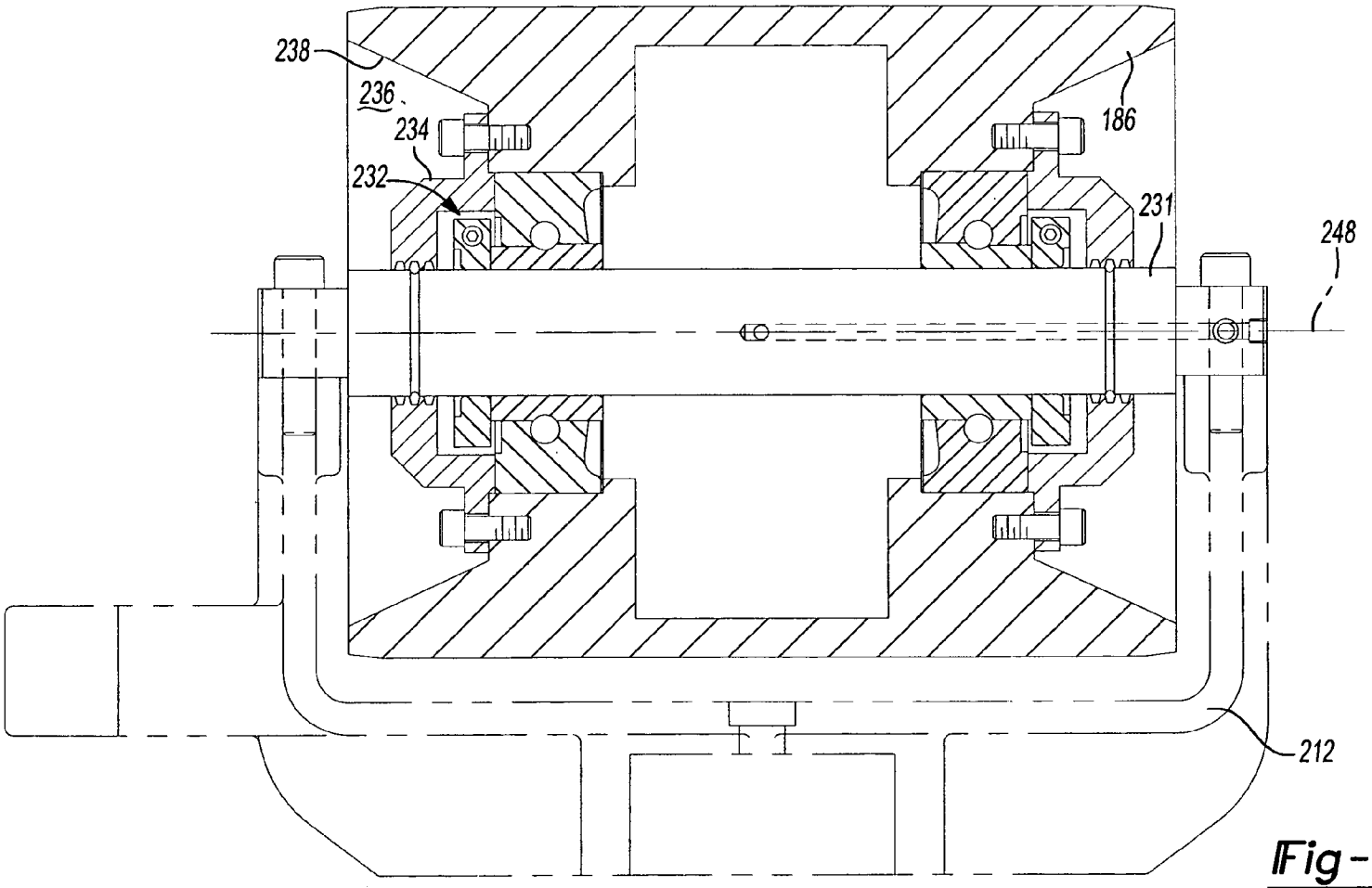
FIG. 15 is a fragmentary cross-sectional view of an idler pulley of the column assembly depicted in FIGS. 11-14.

Idler pulley yoke 212 supports a cross shaft 231 as shown in FIG. 15. Idler pulley 186 is rotatably supported by a pair of bearing assemblies 232 positioned on cross shaft 231. Each bearing assembly 232 is protected from exposure to the swarf by a cap 234 coupled to idler pulley 186. Idler pulley 186 includes a recess 236 having a flared surface 238 angled in a direction to encourage swarf to sling outwardly from idler pulley 186 and contact inner surfaces of shell 194. The swarf is washed out of cavity 196 by the grinding coolant spray system 218.

A grinding belt tracking adjustment apparatus 240 includes a first thumb wheel 242 and a second thumb wheel 244 coupled to shafts operable to rotate a cam 246. Rotation of cam 246 varies the position of idler pulley yoke 212 within cavity 196. By moving idler pulley yoke 212, the positional relationship between an axis of rotation 248 of idler pulley 186 and an axis of rotation 250 of contact wheel 184 may be varied. Proper contact and alignment of grinding belt 208 with contact wheel 184 and idler pulley 186 may be maintained by adjustment of the relative alignment or misalignment between axes 248 and 250.

A second ball screw assembly 260 is mounted to base 38. Column 180 is coupled to second ball screw assembly 260 such that column assembly 50 may be axially translated in a direction substantially parallel to the ground. Second ball screw assembly 260 includes a third servomotor 262 coupled to a slide assembly 264. A precision ball screw 266 is driven by third servomotor 262 to linearly translate slide assembly 264. Slide assembly 264 and ball screw 266 are substantially similar to slide assembly 84 and ball screw 86 previously described and depicted in detail in FIG. 6.

Controller 40 is in receipt of signals indicative of the positions of column assembly 50, regulating wheel assembly 52 and work rest blade assembly 54. The position signals may be provided by encoders associated with the first, second and third servomotors, the first and second ball screw assemblies or other suitable position indicating devices. Axial translation of column assembly 50 allows grinder 20 to accept a wide variety of workpiece diameters and also facilitates the centerless grinding process where contact wheel 184 may be moved toward workpiece 22 during the grinding operation. Controller 40 is operable to simultaneously actuate first, second and third servomotors 82, 140, 262 for each grinding head 24, 26, 28, 30, 32, 34, 36 to allow changeover from a first workpiece diameter to a second workpiece diameter in two to five minutes time. Furthermore, controller 40 is in receipt of a signal indicative of the current being drawn by each drive motor 182. The magnitude of current being drawn provides an indication of the load on contact wheel 184. Graphical interface 42 may display a graphical representation of the current being drawn by drive motor 182 such that an operator may adjust the position of contact wheel 184 and increase or reduce the load on contact wheel 184 as desired.

Figure 19:
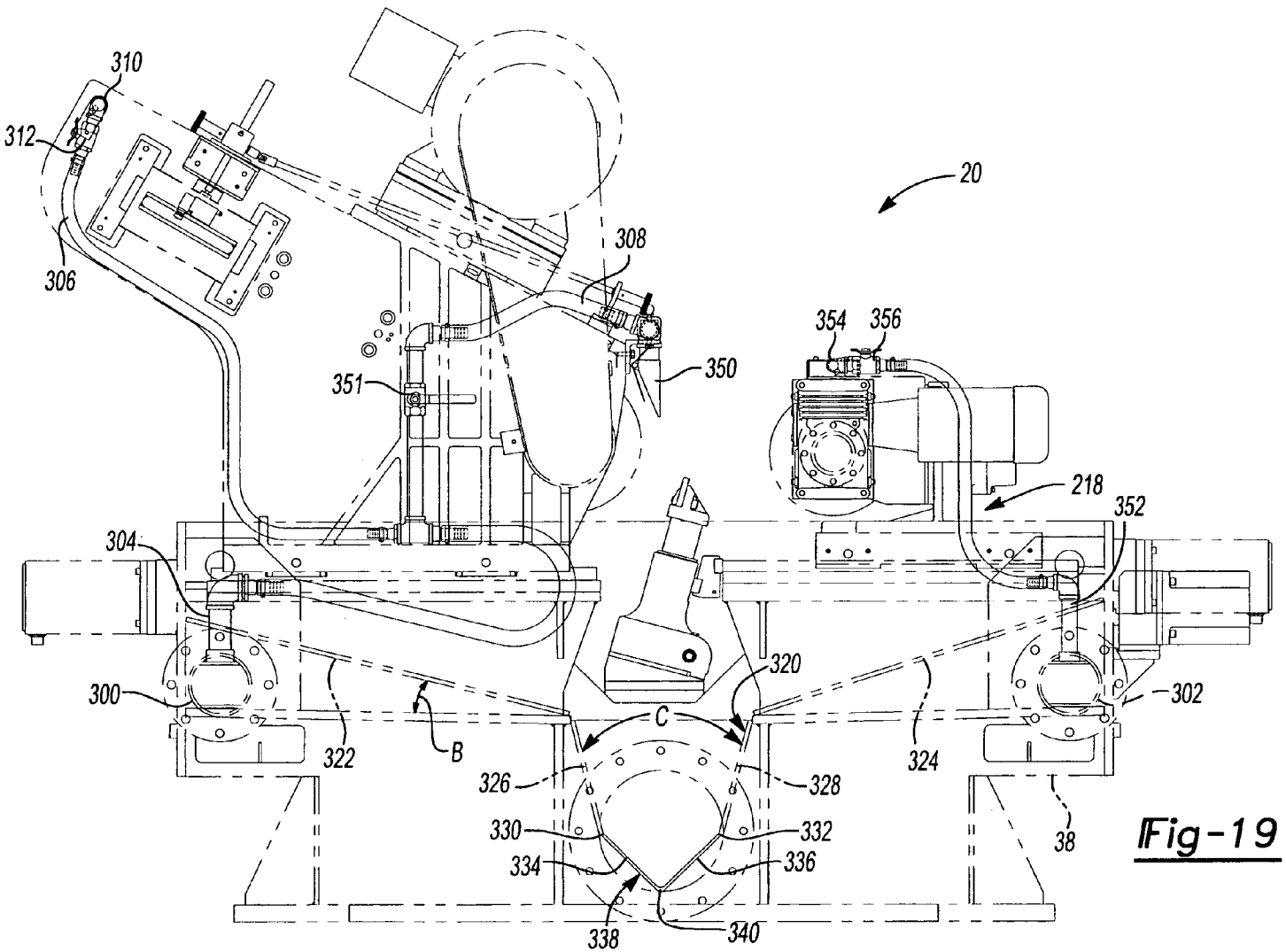
FIGS. 19-21 depict various views of a grinding cooling spray system of the grinder.
Figure 20:
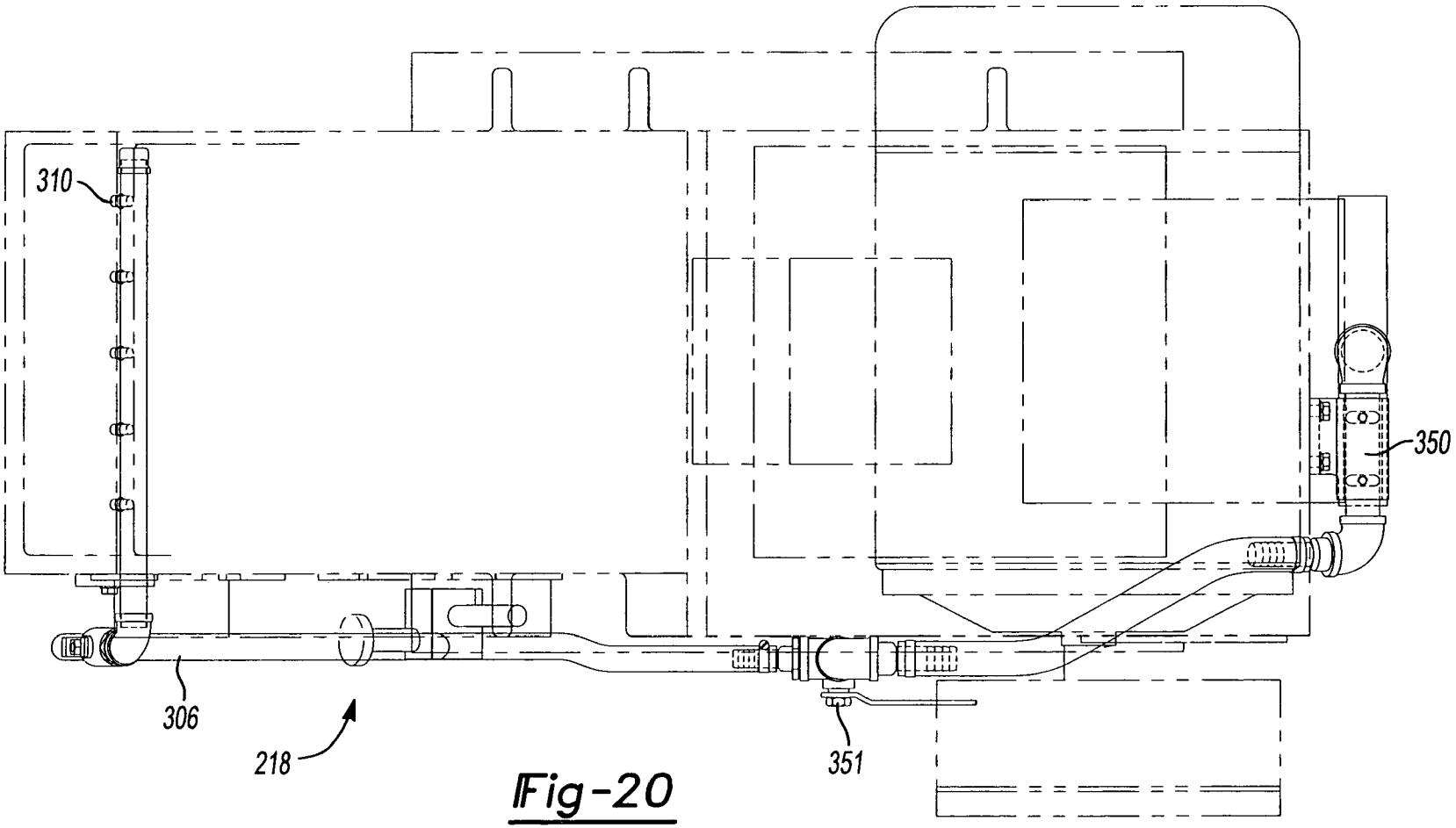
Figure 21:
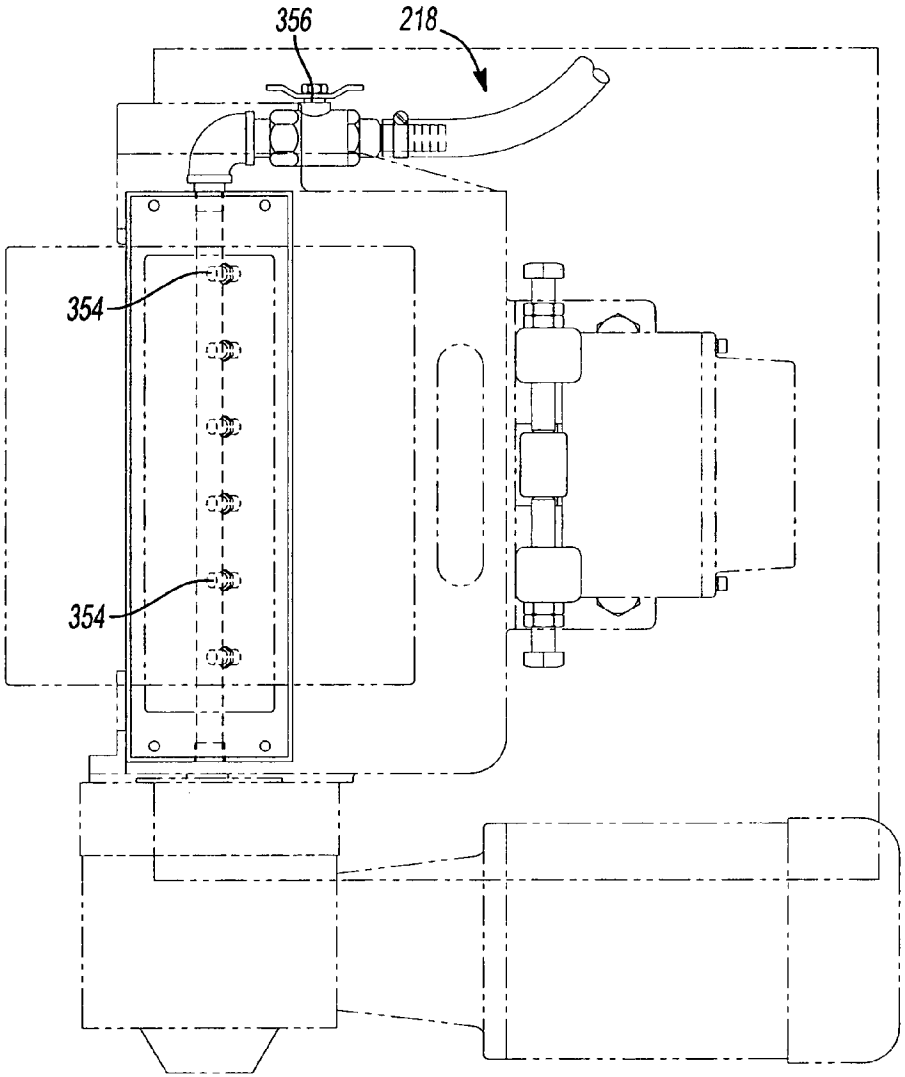

FIGS. 19-21 depict a portion of grinding coolant spray system 218 having a pump (not shown) providing pressurized fluid to a first coolant manifold 300 and a second coolant manifold 302. First coolant manifold 300 and second coolant manifold 302 extend longitudinally along each side of grinder 20. Each of the coolant manifolds 300, 302 are mounted to base 38. The Figures depict portions of grinding coolant spray system 218 cooperating with grinding head 24. It should be appreciated that grinding coolant spray system 218 includes additional components similarly cooperating with grinding heads 26-36. Because the other portions of grinding coolant spray system 218 are substantially similar to one another, only one set of hardware providing coolant to grinding head 24 will be described in detail. A first coolant supply line 304 is in communication with first coolant manifold 300. First coolant supply line 304 provides pressurized fluid to a column branch 306 and a workpiece branch 308. Column branch 306 terminates at a plurality of spray nozzles 310 mounted to column 180 and positioned within cavity 196. FIG. 20 depicts five nozzles 310 directing a pressurized fluid spray on grinding belt 208 and inner surfaces of shell 194 to wash swarf out of cavity 196 and toward a trough 320 coupled to base 38. A valve 312 is positioned in column branch 306 to allow an operator to selectively supply pressurized coolant to spray nozzles 310.

Trough 320 includes a first shed plate 322 and a second shed plate 324 extending inwardly from edges of grinder 20 at an angle "B" approximately 20° relative to the ground. It should be appreciated that angle "B" may deviate from 20° as long as a swarf shuttling function is performed and may range at least between 5° and 45°. The inclination of shed plates 322 and 324 force swarf to travel toward another portion of trough 320 having more vertically oriented side walls 326 and 328.

More particularly, side walls 326 and 328 define a "V" shaped arrangement having an included angle "C" of approximately 30°. Side walls 326 and 328 have lower terminal ends 330 and 332 abutting legs 334 and 336 of a bottom plate 338. Legs 334 and 336 extend substantially perpendicular to one another. A corner 340 is defined at the intersection of legs 334 and 336. Corner 340 is positioned at the lowest point of trough 320. The deepest portion of trough 320 is defined by side walls 326, 328 and legs 334, 336 and is sized to suspend a large quantity of solids within the coolant of the swarf to facilitate moving the solids within the swarf to an end 342 (FIG. 1) of trough 320.

Trough 320 includes a transition from the "V" shaped arrangement shown to a substantially circular cross-section at end 342. Trough 320 may be inclined to force swarf toward one or more ends of the trough or some other location intermediate the ends. The first grinding head 24 encountered by workpiece 22 will typically remove the most material therefrom. Subsequent grinding heads may remove less material to more accurately shape and size the outer surface to a predetermined target. The grinding head that removes the most material from workpiece 22 may be positioned closest to the portion of trough 320 where the swarf is removed from grinding coolant spray system 218. A filter 344 separates the solids from the coolant in the swarf at or near this location. Filtered coolant is pumped back into first and second coolant manifolds 300 and 302.

Branch 308 terminates at a spray nozzle 350 that may be directed to spray pressurized coolant at or near the interface between the workpiece 22 and grinding belt 208. A valve 351 is plumbed in series within branch 308 to allow an operator to selectively supply pressurized coolant to nozzle 350. Swarf generated by the grinding operation is washed down toward trough 320.

A second coolant supply manifold line 352 is integrated with second coolant supply manifold 302 to provide pressurized coolant to a second plurality of nozzles 354. Nozzles 354 are mounted to regulating wheel assembly 52 and operable to selectively spray pressurized coolant on regulating wheel 56. A valve 356 allows an operator to selectively provide pressurized coolant to nozzles 354.

It should be appreciated that grinder 20 is designed to accommodate a very large range of workpiece diameters. This may be accomplished by positioning parallel coolant supply manifolds 300, 302 along the sides of base 38 while trough 320 extends substantially along the longitudinal centerline of grinder 20. Further design flexibility is provided by positioning first servomotor 82, second servomotor 140 and third servomotor 262 outboard of first and second coolant supply manifolds 300, 302. It may also be beneficial to note that each grinding head 24-36 is mounted on a common surface of base 38 to accurately maintain a common axis of workpiece rotation over time.

Figure 22:
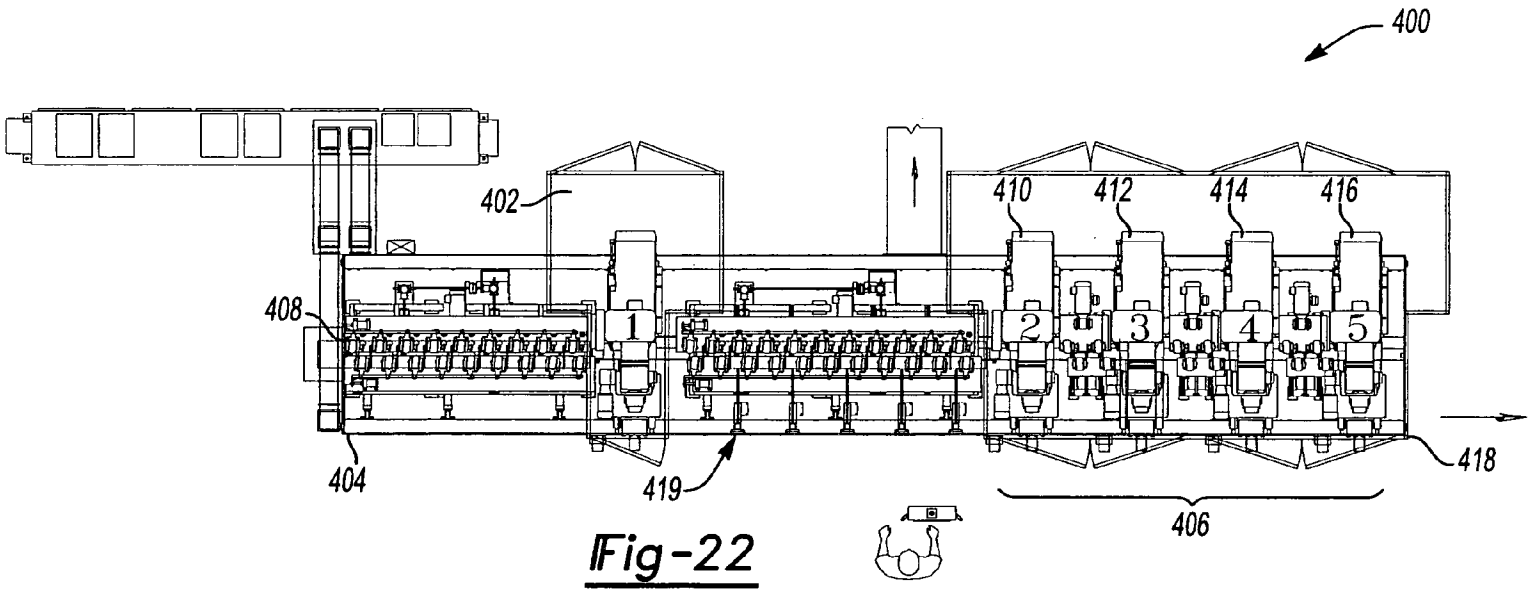
FIG. 22 is a plan view of an alternate grinder.
Figure 23:
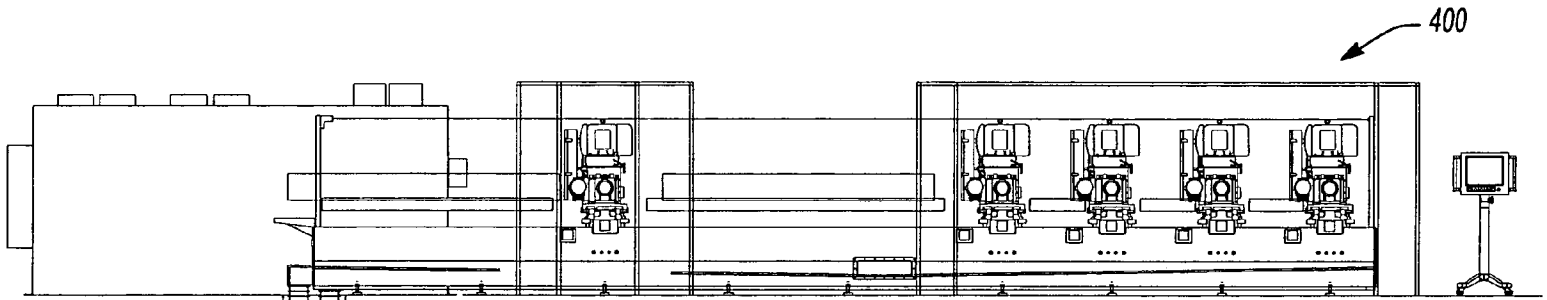
FIG. 23 is a side view of the grinder depicted in FIG. 22.

Another grinder configuration 400 is depicted at FIGS. 22 and 23. Grinder 400 is substantially similar to grinder 20 except that the grinding heads are not substantially equally spaced apart from one another. On the contrary, a first grinding head 402 is spaced apart from a first end 404 of grinder 400 and a group of subsequent grinding heads 406. By positioning grinding head 402 in this manner, a workpiece may be initially supported on a bed 408 and transferred in either direction relative to grinding head 402 to complete the first grinding operation along the entire length of a workpiece. Because the stock used to create ground components varies greatly, it may be desirable to perform a first, or several, rough grinding operations with grinding head 402 and subsequently inspect the workpiece prior to performing grinding operations with grinding heads 410, 412, 414 and 416. After the rough grinding and inspection processes have been completed, it is determined if the workpiece exhibits certain characteristics to either be rejected or be further ground to create a finished product. Accordingly, the workpiece is either shuttled toward a reject station 419 for removal and scrap or shuttled toward a second end 418 where subsequent grinding operations are performed.

Furthermore, the foregoing discussion discloses and describes merely exemplary embodiments of the present invention. One skilled in the art will readily recognize from such discussion, and from the accompanying drawings, that various changes, modifications and variations may be made therein without departing from the spirit and scope of the disclosure.

What is claimed is:

1. A multi-head centerless belt grinder for removing material from a workpiece, the belt grinder comprising:

a plurality of spaced apart grinding heads aligned with one another and adapted to simultaneously remove material from the workpiece;

a coolant spray system supplying coolant to each of the grinding heads;

a trough extending beneath and between each of the grinding heads to collect and transfer swarf generated during the grinding process to a filter operable to separate solids within the swarf from coolant.

2. The belt grinder of claim 1 wherein each grinding head includes a grinding belt, a regulating wheel and a work rest blade, each being adapted to contact the workpiece, the trough further including a first shed plate positioned beneath the grinding belt on one side of a deepest portion of the trough and a second shed plate positioned beneath the regulating wheel on the opposite side of the deepest portion of the trough, each shed plate being angled relative to a ground surface to force swarf toward the deepest portion of the trough.

3. The belt grinder of claim 2 wherein the shed plates are angled between five and forty-five degrees.

4. The belt grinder of claim 3 wherein the trough includes side wall portions extending from the shed plates toward one another and the deepest portion.

5. The belt grinder of claim 4 wherein an included angle defined by the side wall portions is substantially thirty degrees.

6. The belt grinder of claim 5 wherein the trough includes a bottom portion having a substantially "V"-shaped cross-section at the deepest portion, the bottom portion being connected to each side wall portion.

7. The belt grinder of claim 1 wherein the trough is angled relative to the ground to force the swarf toward a filter outlet at the end of the trough.

8. The belt grinder of claim 7 wherein the grinding head closest to the filter outlet at the end of the trough is adapted to remove the greatest amount of material from the workpiece relative to the other grinding heads.

9. A multi-head centerless belt grinder for removing material from a workpiece, the belt grinder comprising:

a plurality of spaced apart grinding heads aligned with one another and adapted to simultaneously remove material from the workpiece;

a coolant spray system supplying coolant to each of the grinding heads; and a trough to collect swarf generated during the grinding process, each grinding head including a column housing a drive motor, a contact wheel and an idler pulley, the column having a bottom wall positioned at an angle relative to the ground to force the swarf from the column toward the trough.

10. The belt grinder of claim 9 wherein the contact wheel and the idler pulley are aligned along an axis positioned at an angle relative to the ground substantially the same as the bottom wall angle.

11. The belt grinder of claim 10 wherein the bottom wall angle ranges from 20 degrees to 70 degrees.

12. The belt grinder of claim 9 wherein the coolant spray system includes spray nozzles mounted within the column.

13. The belt grinder of claim 12 wherein the coolant spray system includes additional nozzles directed at a grinding belt driven by at least one of the drive motors.

14. The belt grinder of claim 13 wherein the coolant spray system includes additional nozzles directed at a regulating wheel adapted to rotate and axially transfer the workpiece.

15. The belt grinder of claim 9 wherein at least one of the idler pulleys includes a flared portion to sling swarf therefrom.

16. A multi-head centerless belt grinder for removing material from a workpiece, the belt grinder comprising:

a first grinding head;

a second grinding head;

a third grinding head;

a fourth grinding head; and a fifth grinding head in that sequential order of arrangement, the first grinding head being spaced apart from the second grinding head a greater distance than the spacing between the second, third, fourth and fifth grinding heads, each grinding head being aligned with one another and adapted to remove material from the workpiece; and a workpiece drive mechanism operable to rotate and bi-directionally transfer the workpiece during grinding by the first grinding head to allow an inspection to occur prior to transfer to the second, third, fourth and fifth grinding heads.

17. The belt grinder of claim 16 further including a reject station adapted to receive workpieces ground by the first grinding head and determined to be outside of a desired specification to avoid undue grinding by the second, third, fourth and fifth grinding heads.

* * * * *